US005667017A

United States Patent [19]

Hoffmann et al.

[11] Patent Number: 5,667,017

[45] Date of Patent: Sep. 16, 1997

[54] ATOMIZER FOR GENERATING WATER-MISTS IN FIRE-FIGHTING SYSTEMS

[75] Inventors: Rolf Hoffmann; Jörg Mücke, both of Oschersleben, Germany

[73] Assignee: Awab Umformtechnik GmbH & Co. KG, Oscherslegen, Germany

[21] Appl. No.: 526,450

[22] Filed: Sep. 11, 1995

[30] Foreign Application Priority Data

Sep. 17, 1994 [DE] Germany ..... 44 33 157.6

[51] Int. Cl.[6] ..... A62C 37/08

[52] U.S. Cl. ..... 169/38; 169/37

[58] Field of Search ..... 169/37, 38, 40, 169/42

[56] References Cited

U.S. PATENT DOCUMENTS

| | | | |
|---|---|---|---|
| H121 | 9/1986 | Pieczykolan | 169/37 |
| 2,511,945 | 6/1950 | Rowley | 169/42 |
| 3,818,994 | 6/1974 | Livingston | 169/37 |
| 3,831,682 | 8/1974 | Calcaro | 169/37 |

FOREIGN PATENT DOCUMENTS

| | | | |
|---|---|---|---|
| 648027 | 9/1962 | Canada | 169/38 |
| 78 15 775 | 3/1977 | Germany . | |
| 25 39 703 | 5/1978 | Germany . | |
| 207663 | 3/1984 | Germany | 169/37 |

*Primary Examiner*—Gary C. Hoge

*Attorney, Agent, or Firm*—Shlesinger, Arkwright & Garvey

[57] ABSTRACT

A fire-fighting system, which includes a nozzle housing having a turbulence chamber with a nozzle aperture communicating with the turbulence chamber and a temperature responsive compressive element which gives way at a specified temperature, and which compressive element and a sealing unit for the nozzle are held in place against the nozzle by a spring under compression which is released when the compression element gives way at a specified temperature.

18 Claims, 3 Drawing Sheets

ATOMIZER FOR GENERATING WATER-MISTS IN FIRE-FIGHTING SYSTEMS

Figure 1:
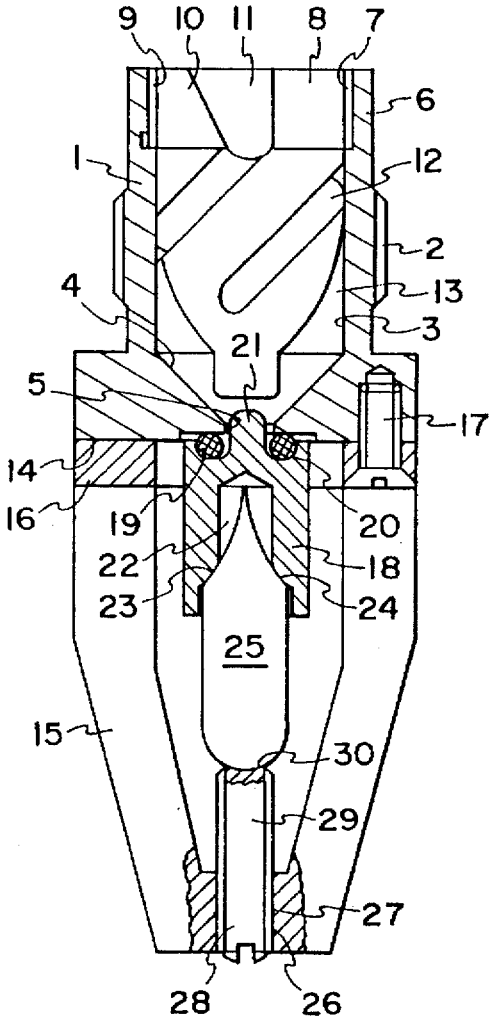

This invention relates to atomizers for generating water mists in fire-fighting systems and particularly to those which include an adjustment mechanism for the compressive element whether by screw or by spring action.

The in-house print "herzog Wasservernebelungstechnik" of HERZOGWASSERVERNEBELUNGSTECHNIK GMBH, at 39387 Oschersleben, describes an atomizer of the pertinent kind, which comprises a turbulence chamber evincing narrow, coiled ducts leading to a narrow, coaxial nozzle aperture. The coiled ducts impart rotation to the water flowing through them. The rotational speed is substantially raised along the radially inward path toward the narrow, coaxial nozzle aperture, as a result of which the liquid when leaving said aperture is torn by the centrifugal forces then acting on it into a spray mist.

This known atomizer is used in such a way that several atomizers are connected by tubes to a common shutoff valve. The shutoff valve is connected through a conduit, filled with pressurized water as far as the shutoff valve, to a water supply. The nozzle apertures of the atomizers are open. In order to ascertain a fire-caused rise in the ambient temperature, a thermoplastic hose is provided, which is filled with water under control pressure. The control pressure is monitored by a pressure sensor or the like which may drive the shutoff valve. If on account of fire the ambient temperature rises above a predetermined temperature, then the hose shall burst and hence the control pressure in the hose shall drop, whereby the shutoff valve will open. Thereupon the pressurized water flows through the pipes to the atomizers and issues through the particular nozzle apertures, a spray mist being formed in the process by the atomizers in the manner described above.

The known atomizer entails a drawback in that the pressure sensor monitoring the control pressure in this hose and the shutoff valve driven by this pressure sensor are complex and hence costly.

The hose must pass through all fire-jeopardized areas, and large quantities of hose are needed to monitor large areas. High costs and complexities are consequently incurred when installing the hose lines. Additionally, temperature fluctuations in the long hose lines may result in a pressure drop. If the control pressure in the hose line drops below a predetermined value, then the shutoff valve will open without a fire to be controlled being extant. Also, if there are leaks causing water loss from the hose line and a drop in the control pressure, then there will be the danger of false-alarm initiation. Such spurious initiations entail extraneous water damage.

Following a fire, the entire hose line must be changed and be installed anew. For setup, the hose line must be filled with water again and be pressurized at the control pressure. This procedure is laborious, time-consuming and expensive.

Several atomizers being connected to the same shutoff valve, a localized fire will also drive atomizers far from the site of the fire. Extraneous water damage is the result.

The atomizer nozzle aperture is always open and hence easily soiled. Consequently atomizer operation is degraded.

Sprinkler nozzles are illustratively known from the German Offenlegungsschrift 25 39 703 wherein a deflecting sheetmetal linked by a retaining bail to the sprinkler-nozzle housing is mounted a distance in front of a discharge aperture in said housing. A substantially cylindrical rupture unit rests against an adjustment screw affixed centrally in the impact plate and by means of its end facing the discharge aperture holds a sealing element tightly sealing the said aperture when in the sealing position. The supply conduits are filled with water up to the sprinkler nozzles.

In case of fire, the rupture unit will burst when an initiating temperature is reached and a concentrated water jet will issue from the discharge aperture and hit the impact plate mounted in the zone of the water jet. Water drops are generated with a size less than optimal for fire control and frequently leading to extraneous water damage.

An essential difference between a pertinent atomizer and a sprinkler nozzle is that the sprinkler nozzle requires an impact plate for lateral water scattering, whereas an impact plate is not needed in an atomizer wherein instead the water is torn into a spray mist when leaving the nozzle aperture and is spread about in this manner.

The object of the invention is to create an atomizer of the pertinent kind which shall be free of the cited drawbacks, which is simple in design and hence allows economic manufacture, which prevents both extraneous water damage caused by false alarms and fire-fighting with drop sizes other than optimal, and which following a fire can be restored in simple and time-saving manner.

This problem is solved by the disclosure of claim 1.

The basic concept of the present invention is based on an atomizer and the use of its advantageous properties when spraying mist to fight fires. A further concept of the invention is to modify the atomizer in that each atomizer shall comprise a sealing unit tightly sealing the nozzle aperture and being pressed by a compressive element which shall give way at a predetermined temperature of initiation, against the housing.

Accordingly the pipes may be filled with pressurized water up to the atomizers. When on account of fire the initiation temperature is reached, the compressive element will give way and no longer tightly press the sealing unit against the housing. The water pressure forces the sealing unit outward, as a result of which the nozzle aperture is reared and the water then will issue from the nozzle aperture and form a spray mist.

Accordingly each atomizer can be operated separately from the others, and in case of localized fire, only those atomizers will be operative of which the ambient temperature exceeds a predetermined value on account of fire. Atomizers far from the site of fire therefore remain inoperative and extraneous water damage is averted. Neither a water-filled hose, nor a pressure sensor and a shutoff valve driven by said sensor are required. Therefore fire-fighting systems using the atomizer of the invention evince simple designs and can be manufactured economically.

Because the sealing unit tightly seals the atomizer nozzle aperture, soiling of the latter is reliably precluded. And because the sealing unit rests externally against the housing, damage to the nozzle aperture is prevented.

Following a fire, no more need be done than again placing the sealing unit against the housing and using a new compressive element pressing the sealing unit. Accordingly restoration is simple, economical and time-saving.

In a development of the invention, the compressive element rests against an adjustment screw. In this manner the pressure of the compressive element on the sealing unit forced thereby against the housing is adjustable.

The compressive element also may rest against a spring instead of the above adjustment screw, the spring obviously evincing such properties that the nozzle shall remain closed to the supply conduits under all pressure conditions but not in the case of fire. The spring offers the advantage of simple design. Moreover it allows compensating manufacturing tolerances.

As regards the embodiment comprising the adjustment screw, the compressive element appropriately may be made spherical or conical at its end away from the nozzle aperture in order to rest in a preferably spherical clearance in the adjustment screw. With such a design, the compressive element will center in the said spherical clearance of the adjustment screw when the atomizer is being assembled. Assembly is simplified thereby.

The shape and size of the compressive element may vary within wide limits. Appropriately however it will be substantially cylindrical.

Appropriately the compressive element is a glass or similar hollow body filled with a liquid, preferably alcohol, which shall strongly expand when heated, or evaporate. The materials required to manufacture the compressive element are economical. Arbitrary liquids may be used. By selecting liquids with suitable properties of expansion, the temperature at which the compressive element shall give way may be set within wide limits.

Appropriately the part linked to the housing is a bail extending from the housing and away from the nozzle aperture. The bail may be made small, so that it shall subtend only a small spraying shadow which will not significantly degrade the atomizer's extinguishing effect.

In this embodiment the bail may be integral with the housing. This embodiment is especially simple and hence can be manufactured in especially economical manner.

In a further development of the embodiment, the bail consists of flat straps of which the radial cross-sections extend in the radial direction of propagation of the spray mist. In this design, the bail's spraying shadow is reduced further.

In another embodiment, the compressive element detachably rests against a support linked to the housing. Illustratively the support is clamped to the housing.

Appropriately the sealing unit may comprise an annular channel on its side away from the nozzle aperture and a distance from latter, said channel receiving an elastomeric sealing ring. This design is simple and hence allows economic manufacture.

In this embodiment, the compressive element appropriately comprises on its side away from the nozzle aperture a centering pin coaxial with the annular channel and entering the nozzle aperture. During assembly, the sealing unit centers on the nozzle aperture and as a result sideways slippage of the sealing unit from the nozzle aperture is precluded. Thereby assembly is simplified further.

An exceedingly advantageous further development of the invention provides that the compressive element be resting by a support detachably affixed to the housing, that the support be in the form of a fork with two legs displaceable in the direction of spreading apart, that the end of the legs when the atomizer is in the rest position will geometrically lock-in behind a radial housing projection, that the legs are prestressed in the spreading-apart direction and that they comprises protrusions engaging the compressive element at its rear in such manner that in the atomizer rest position, the legs will be secured against spreading apart. In this embodiment, the support legs prestressed in the spreading direction will spread apart so much when the compressive element is giving way that the leg ends are released from the housing projections and that the support detaches from the housing, whereby the zone in from of the atomizer is clear and any spraying shadow is eliminated.

In a further development of this embodiment, at least one of the support legs is in the form of a spring and thereby constitutes the resilient means. By appropriate selection of shape, size and material of the legs, the leg prestressing for the atomizer rest position may be selected within wide limits.

Appropriately the fork legs in the above embodiment are made of spring steel. This design is simple and allows economic manufacture.

Another development of the invention comprising the fork-shaped support provides that the leg protrusions are each constituted by an inward extending strap each comprising a clearance allowing passage of the compressive element for the atomizer rest position.

Another development of this embodiment provides that in the atomizer rest position, the said straps are mutually spaced and mounted in the direction of the nozzle axis. Thereby remaining parts, for instance remaining fragments of a rupture unit when the compressive element is giving way, are prevented from being jammed into the strap clearances whereby the legs would be prevented from moving and hence the support would be prevented from spreading apart. Atomizer reliability is further improved in this manner.

In a further appropriate development of the above embodiment, at least one of the straps comprises a beak facing the other strap to assure the spacing between them.

Appropriately the strap and the leg always are integral. This embodiment is simple and thereby can be manufactured economically because thereby the strap is no separate part requiring connection to the leg.

Another development of the embodiment comprising the spring and spring-steel legs provides that the spring preferably is in the form of an integral leaf spring with resilient legs. This design is simple and can be manufactured economically.

The clearance may be closed or open on the side. A closed clearance for instance may be in the form of a borehole through the strap. As regards a laterally open clearance, the strap forms a hook gripping the compressive element from behind.

Another development of the embodiment with clearances provides that they are wider on their side away from the compressive element when being forced against it and that in particular they form an elongated hole. Elongated holes reduce the danger that when the compressive element gives way, residual fragments of it shall jam into the clearances and prevent mutual displacement of the straps.

The housing projection may be in the form of a collar. The support legs grip the collar from behind and thereby the support is reliably held against the housing in the atomizer rest position.

In an especially advantageous development of the embodiment comprising the collar, this collar comprises two radial, peripheral clearances which are diametrically opposite and of which the diametrical spacing corresponds to the diametrical separation between the free leg ends in the atomizer rest position. In this embodiment, first the legs are compressed toward each other and prestressed when assembling the atomizer and are secured against spreading apart by insertion of the compressive element. Thereupon the support is deposited on the housing in a position of rotation wherein the leg ends are located in the vicinity of the radial collar clearances and axially in the direction of nozzle axis. Next the support will be rotated about 90° about the nozzle axis, whereby the leg ends grip the collar from behind. In this embodiment the support is secured by some kind of a bayonet lock to the housing, and accordingly atomizer assembly is simple.

Another advantageous development of the embodiment comprising the collar provides that the collar's rest surface for the leg ends shall flare conically toward the support. The conical rest surface further improves the release of the leg ends from the collar when the support is spread apart.

As regards the embodiment comprising the support in the form of a fork, the compressive element also may be a melting body when at the initiation temperature. This feature is not easily achievable in atomizers of which the part supporting the compressive body does not detach together with the compressive element from the housing, because the element is cooled by water issuing from the nozzle aperture, thereby interrupting fusion, and the compressive element in the vicinity of the nozzle aperture hampering propagation of the spray mist.

The invention is elucidated below in relation to an illustrative embodiment and the attached drawings.

Figure 3:
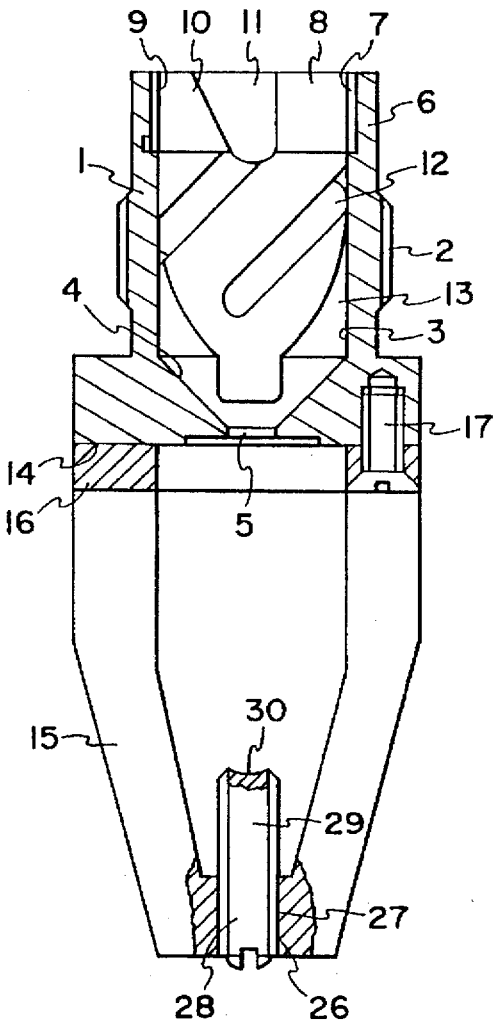
Figure 2:
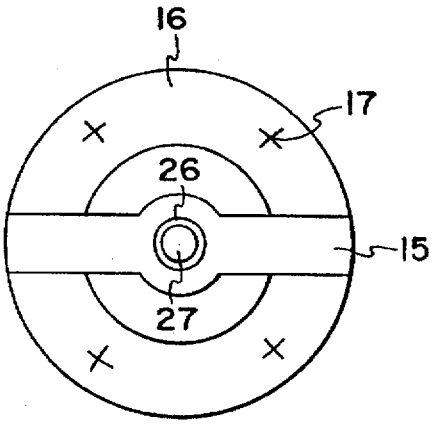
Figure 4:
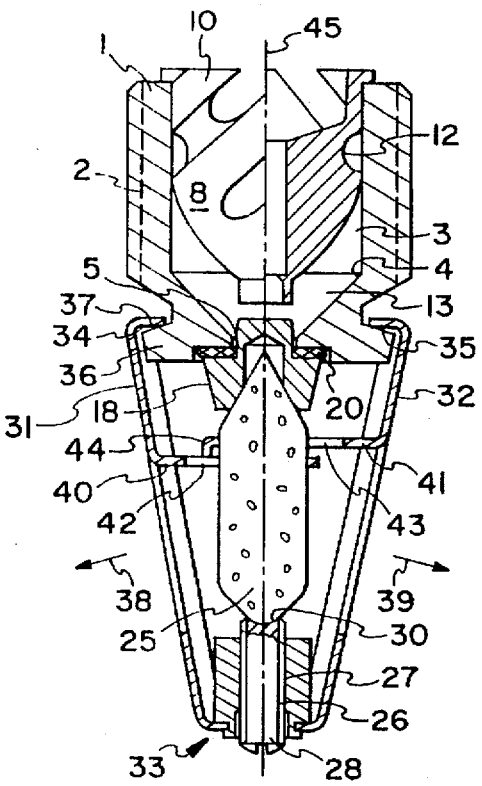
Figure 5:
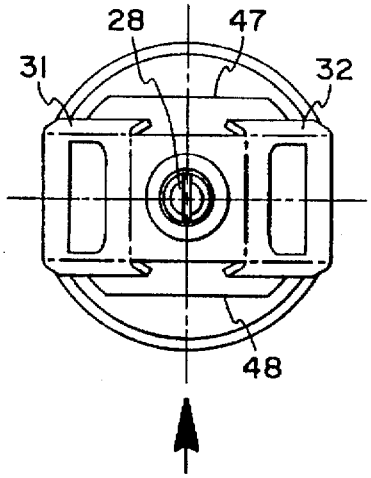
Figure 6:
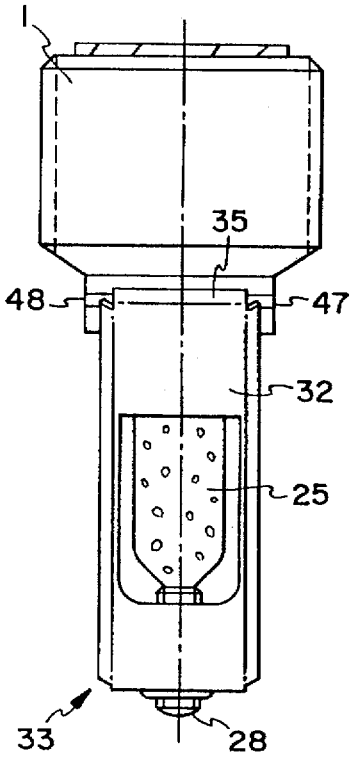
Figure 7:
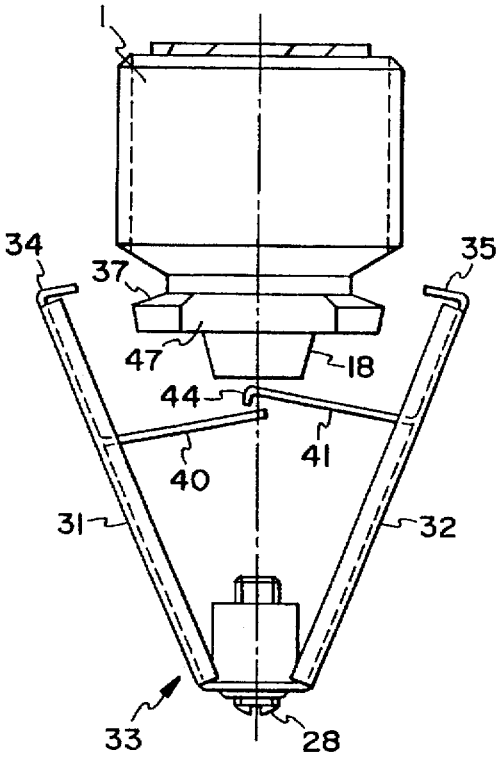
Figure 8:
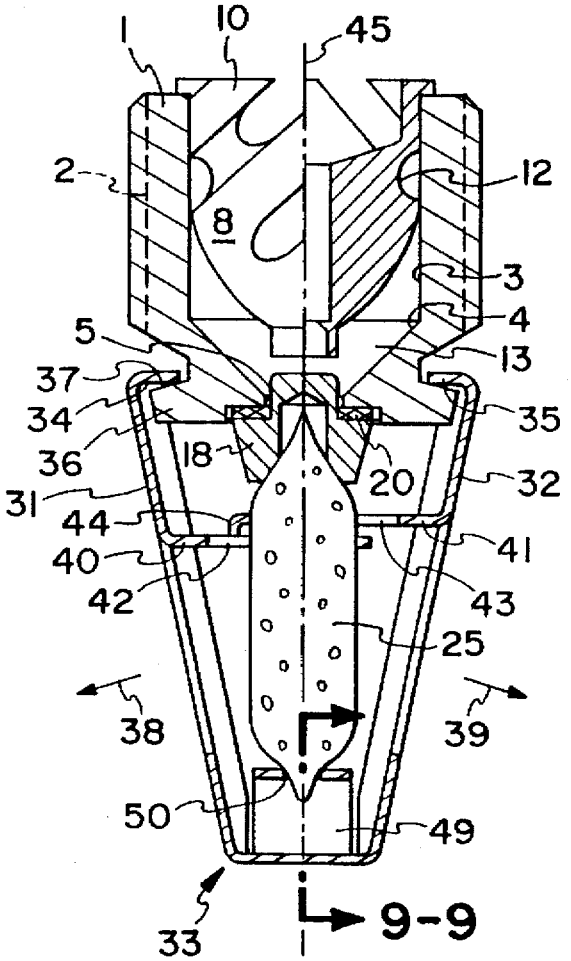
Figure 9:
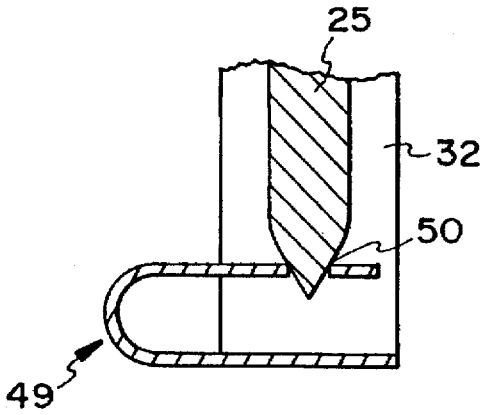

FIG. 1 is a first embodiment of the atomizer of the invention in its rest position and shown in partially sectional sideview, FIG. 2 is a view from below of the atomizer of FIG. 1, and FIG. 3 shows the atomizer of FIG. 1 in its operational state in partially sectional sideview, FIG. 4 is a second embodiment of the atomizer of the invention in its rest state in partially sectional sideview, FIG. 5 is a view from below of the atomizer of FIG. 4, FIG. 6 is a sideview of the atomizer of FIG. 4, FIG. 7 is a sideview of the atomizer of FIG. 4 when the support is detached from the housing, FIG. 8 is a third embodiment of the atomizer of the invention in its rest state shown in the manner of FIG. 4, and FIG. 9 is a partial section IX—IX through FIG. 8.

The same references denote the same components in the Figures.

The atomizer shown in FIG. 1 comprises a housing 1 fitted with an outer thread 2 to screw the atomizer into an omitted supply conduit. The housing 1 comprises a cylindrical inside wall 3 merging into a conical inside wall 4 and issuing into a nozzle aperture 5. The end 6 of the cylindrical wall 3 away from the nozzle aperture 5 is fitted with an inside thread 7 receiving an atomizer component 8 with an outer thread 9. The atomizer component 8 comprises a supply aperture 11 at its end 10 away from the nozzle aperture, water from the supply conduit being fed through said supply aperture 11 to the atomizer. The atomizer component 8 is externally fitted with narrow, helical channels 12, a turbulence chamber 13 being subtended between the atomizer component 8 and the cylindrical inside wall 3 or conical inside wall 4 and communicating with the nozzle aperture 5. A bail 15 extending at the housing 1 away from the nozzle aperture 5 is held by its annular zone 16 formed at its end facing the housing 1 against an annular zone 14 of the housing 1, the zone 14 being coaxial with the nozzle aperture 5, this bail 15 being detachably fastened to the housing 1 by screws of which only one, screw 17, is shown in illustrative manner. In the atomizer rest position shown in FIG. 1, the nozzle aperture 5 is sealed by a sealing unit composed of a sealing bush 18 and an elastomeric sealing ring 20 placed in an annular channel 19 formed into the side of the sealing bush 18 which faces the nozzle aperture. At its side facing the nozzle aperture 5, the sealing bush 18 comprises a centering pin 21 coaxial with the annular channel 19 and passing into the nozzle aperture 5. At its side away from the nozzle aperture 5, the sealing bush 18 comprises a central borehole 22 flaring away from the nozzle aperture 5 into a substantially conical zone 23 and comprising a rest surface 24 for a compressive element 25. The compressive element 25 in this embodiment consists of an alcohol-filled hollow glass body having conical ends as noted in FIG. 4. The end of the compressive element 25 facing the nozzle aperture 11 is substantially conical and rests against the rest surface 24 of the sealing bush 18. The end of the compressive element 25 away from the nozzle aperture 5 is spherical. By means of an adjustment screw 28 threaded into an inside thread 26 of a borehole 27 of the bail 15 and comprising at its end 29 facing the compressive element 25 a spherical recess 30 resting against the spherical end of the compressive element 25, it is possible to prestress the compressive element 25 and the sealing unit in the direction of the nozzle aperture 5. It is clear from inspection that as the adjustment screw 28 is threaded deeper into the inside thread 26 of the borehole 27, the compressive element 25 and the sealing bush 16 will be prestressed even more toward the nozzle aperture 5 with simultaneous elastic deformation of the sealing ring 20, as a result of which the nozzle aperture shall be sealed tightly and water discharge shall be precluded in the rest position of the atomizer.

FIG. 2 shows that the ball 15 is narrow and consequently a spray mist may form in the atomizer's operational state and may cover a wide portion of the atomizer circumference. Accordingly only a minor spraying shadow is subtended by the bail 15, and this shadow will not significantly degrade the extinguishing efficacy of the atomizer.

As the ambient temperature rises, the alcohol in the compressive element 15 expands until, at an ambient temperature predetermined by the thermal expansion of the alcohol, the compressive element 25 gives way by bursting. Consequently, under pressure from the water at the atomizer intake, the sealing bush 18 together with the sealing ring 20 is expelled from the nozzle aperture 5 and drops out. As a result the atomizer passes into the operational state shown in FIG. 3, wherein the nozzle aperture 5 is open. The water flows through the narrow, helical channels 12, being eddied in the turbulence chamber 13 and then issues from the nozzle aperture 5, whence a spray mist forms underneath the atomizer.

Because of its minute drop size, the spray mist so generated is well suited to fight fires, and only those atomizers shall be operational in case of fire of which the ambient temperature rose above the predetermined magnitude on account of fire. Thereby extraneous water damage is reliably averted.

FIG. 4 shows a second embodiment of the atomizer of the invention, which comprises a support 33 in the form of a fork with two legs 31, 32. The free ends of the legs 31, 32 are hooks gripping, from behind, a projection in the form of a collar 36 at the housing 1. A rest surface 37 for the hooks 34, 35 located at the collar 36 flares conically toward the support 33. The support 33 is able to spread apart and the legs 31, 32 are displaceable resp. in the direction of the arrow 38, 39 symbolizing the direction of spreading.

The legs 31, 32 are made of spring steel and thereby form a resilient means prestressing the legs 31, 32 in the atomizer rest position shown in FIG. 4 toward the spreading-apart direction. Each leg 31, 32 comprises an inward pointing strap 40, 41 fitted with an elongated clearance 42, 43 in the embodiment of FIG. 4. The straps 40, 41 are approximately mutually parallel in the atomizer rest position. At its free end the strap 41 comprises a beak 44 pointing toward the other strap 40 to assure that the straps 40, 41 shall be spaced from each other in the direction of the atomizer axis denoted by the dot-dash line 45.

In the atomizer rest position shown in FIG. 4, the compressive element 25 rests by its end away from the nozzle aperture 5 against the adjustment screw 28 of the support 33 and by means of its end facing the nozzle aperture 5 presses the sealing pane 20 by means of the sealing bush 18 against the housing 1, whereby, in the atomizer rest position, the nozzle aperture 5 is tightly sealed. In the process the compressive element 25 extends through the elongated clearances 42, 43 in the straps 40, 41 which thereby grip the compressive element 25 from behind and the legs 31, 32 are secured against spreading apart for the atomizer rest position.

FIG. 5 is a view of the atomizer of FIG. 4 from below. In this embodiment the collar 36 comprises two diametrically opposite, radial clearances 47, 48 formed by flats and of which the diametrical separation corresponds to that between the ends of the legs 31, 32 taking the form of hooks 35, 36. When assembling the atomizer, the legs 31, 32 of the support 33 are compressed and prestressed thereby. Then the compressive element 25 is introduced from the free ends of the legs 31, 32 through the elongated clearances 42, 43 until its end facing the adjustment screw 28 comes to rest against this screw. Next the support 33 with its inserted compressive element 25 is axially deposited on the housing 1. At such an angle of rotation that the hooks 34, 35 shall be located in the vicinity of the flats 47, 48. Thereupon the support 33 is rotated by about 90° at the housing 1 about the atomizer axis 45 in order that the hooks 34, 35 thereby shall grip from behind the collar 36 of the housing 1. In this manner the support 33 is secured like a bayonet lock to the housing 1 and hence assembly of the atomizer of the invention upon first installation or after a fire is feasible in especially simple manner.

FIG. 6 is a sideview of the atomizer in its rest position.

The operation of this embodiment of the atomizer of the invention is elucidated below in relation to FIG. 7. In case of fire, the temperature in the vicinity of the atomizer rises until the compressive element 25 gives way at an initiation temperature. Consequently the legs 31, 32 no longer hold the compressive element 25 from behind by means of their straps 40, 41 and hence the prestressed legs 31, 32 move in the direction of the arrows 38, 39 and the support 33 spreads apart. The clearances in the straps 40, 41 are elongations 42, 43 and on account of the spacing between these straps 40, 41 in the direction of the atomizer axis, the motion of the legs 31, 32 and hence the spreading-apart of the support 33 is reliably assured against any hampering remnant parts of the compressive element 25.

On account of the motion of the legs 31, 32 in the direction of the arrows 38, 39, the hooks 34, 35 clear the collar 36 and thereby the support 33 detaches off the housing 1 and, for the assembled state of the atomizer shown in FIG. 7, will then drop. The release of the hooks 34, 35 from the collar 36 is facilitated further in that the rest surface 37 flares conically toward the support 33.

When the compressive element 25 gives way, the sealing bush 18 together with the sealing ring 20 is forced outward by the water pressure in the atomizer and as a result the atomizer becomes operational. Because the support 33 was detached from the housing 1 when the compressive element 25 gave way, the vicinity in front of the atomizer is clear and the spraying mist can propagate unhampered in front of the atomizer. Accordingly spraying shadows are entirely absent and the extinguishing efficacy of the atomizer of the invention is further improved in the embodiment shown in FIGS. 4 through 7.

FIG. 8 shows a third embodiment of the atomizer of the invention, which differs from that of FIG. 4 in that the compressive element 25 rests not against an adjustment screw but against a spring which in this instance is a leaf spring 49 integral with the resilient legs 31, 32. The leaf spring 49 prestresses the compressive element 25 toward the nozzle aperture 5 and its spring force is chosen such that the atomizer shall remain sealed under all pressures and will open only in case of fire. Moreover the leaf spring 49 will compensate manufacturing tolerances. By its end away from the nozzle aperture 11, the compressive element 25 enters a clearance 50 in the zone of the free end of the leaf spring 49.

FIG. 9 is a section IX—IX of FIG. 8. It shows that the leaf spring 49 is integral with the legs 31, 32 and that for the atomizer rest position shown in FIG. 9, the spring 49 is bent at its free end in such a direction toward the nozzle aperture 5 that a portion of the leaf spring 49 facing the nozzle aperture 5 and comprising the clearance 50 is mounted at a space from and parallel to a part away from the nozzle aperture.

We claim:

1. An atomizer for generating a water mist in fire-fighting systems, comprising a housing, a turbulence chamber mounted in the housing, and a nozzle aperture communicating with said turbulence chamber, and including:

a) a sealing unit (18, 20) externally resting against the housing (1) and tightly sealing the said nozzle aperture (5);

b) a compressive element (25) pressing the sealing unit (18, 20) against said nozzle aperture and giving way at a specified initiation temperature;

c) said compressive element having one end resting away from said sealing unit (18, 20) against a part (33) connected with said housing (1);

d) said part including releasable spring means when connected to said housing (1) being compressed for connection to said housing (1); and e) whereby when said compressive element gives way at a specified temperature, said sealing unit will be unseated from said nozzle aperture to permit said atomizer to generate water mist.

2. An atomizer as in claim 1 and wherein:

a) said releasable spring means (33) includes an adjustment screw (28) against which the compressive element (25) rests.

3. An atomizer as in claim 1 and wherein:

a) said sealing unit (18, 20) includes an annular channel (19) spaced from said nozzle aperture (5); and b) said channel including an elastomeric sealing ring (20).

4. An atomizer as in claim 3 and wherein:

a) said sealing unit (18) comprises a centering pin (21) coaxial with the annular channel (19) facing and entering said nozzle aperture (5).

5. An atomizer for generating a water mist in fire-fighting systems, comprising a housing, a turbulence chamber mounted in said housing, and a nozzle aperture communicating with said turbulence chamber, and including:

a) a sealing unit (18, 20) externally resting against the housing (1) and tightly sealing the nozzle aperture (5);

b) a compressive element (25) pressing the sealing unit (18, 20) against the housing (1) and giving away at a specified initiation temperature, said compressive element having one end resting against a support (33) connected with said housing (1);

c) said support including a fork having two legs (31, 32);

d) said housing including projections for locking said legs (31, 32) in a first pre-stressed position; and e) said legs including protrusions gripping said compressive element (25) for securing said legs against being spread apart prior to activation of said atomizer.

6. An atomizer as in claim 5 and wherein:

a) At least one of said legs (31, 32) is a spring.

7. An atomizer as in claim 6 and wherein said at least one of said legs (31, 32) is of spring steel.

8. An atomizer as in claim 7 and wherein said legs (31, 32) each include an inward extending strap (40, 41) evincing a clearance through which passes the compressive element (25) when the atomizer is in the rest position.

9. An atomizer as in claim 8 and wherein:

a) said inwardly extending straps (40, 41) are mutually spaced laterally apart from each other.

10. An atomizer as in claim 9 and wherein:

a) at least one of said straps (40, 41) comprises a beak (44) said for maintaining spacing between said straps (40, 41).

11. An atomizer as in claim 8 and wherein:

a) said straps (40, 41) and legs (31, 32) are integral.

12. An atomizer as in claim 11 and wherein:

a) said spring means includes a leaf spring.

13. An atomizer as in claim 8 and wherein:

a) said clearances of said extending straps (40, 41) face each other.

14. An atomizer as in claim 8 and wherein:

a) said clearances flare away from said compressive element (25) and form elongated holes (42, 43).

15. An atomizer as in claim 5 and wherein said radial projections at said housing (1) include a collar (36).

16. An atomizer as in claim 15 and wherein:

a) said collar (36) includes a periphery having two diametrically opposite radial clearances (47, 48); and b) said two legs (31, 32) include free ends (34, 35) having diametrical spacing corresponding to the diametrical spacing between said clearances when said sealing unit (18, 20) is resting against the housing (1) tightly sealing the nozzle aperture (5).

17. An atomizer as in claim 15 and wherein:

a) said collar (36) is conically flared toward said support (33).

18. An atomizer as in claim 5 and wherein:

a) said compressive element (25) is a body bursting when the initiation temperature is reached.

* * * * *